United States Patent [19]

Imatt

[11] 4,244,581

[45] Jan. 13, 1981

[54] GAME WITH PIECES PREVENTING ADJACENT PLACEMENT

[75] Inventor: Alex Imatt, Chicago, Ill.

[73] Assignee: Marvin Glass & Associates, Chicago, Ill.

[21] Appl. No.: 953,895

[22] Filed: Oct. 23, 1978

[51] Int. Cl.[3] ..... A63F 3/00

[52] U.S. Cl. ..... 273/282; 273/288; 273/236

[58] Field of Search ..... 273/236, 281, 288

[56] References Cited

U.S. PATENT DOCUMENTS

| | | | |
|---|---|---|---|
| 2,757,934 | 8/1956 | Dunbar | 273/288 |
| 2,807,470 | 9/1957 | Keuls | 273/236 |
| 3,193,293 | 7/1965 | Schaper | 273/288 |
| 3,466,044 | 9/1969 | Somerville | 273/288 |
| 3,649,023 | 3/1972 | Schohn | 273/272 |

OTHER PUBLICATIONS

*GO; Games of the World;* Holt, Rinehart, Winston; p. 42; Copy. 1975.

*Primary Examiner*—Richard T. Stouffer
*Assistant Examiner*—R. Carl Moy
*Attorney, Agent, or Firm*—Mason, Kolehmainen, Rathburn & Wyss

[57] ABSTRACT

A game apparatus includes a game board containing an array of playing spaces separated from one another by grooves which run in rank and file order. The game apparatus includes at least two separate sets of playing pieces, which during the game are placed on the spaces and the grooves act as locators or receivers for insertion of projections on the playing pieces. The players may place the playing pieces upon any playing space which is playable and not blocked by a playing piece from another set according to the rules of the game. In an alternate embodiment a second set of projections physically present incorrect placement.

3 Claims, 4 Drawing Figures

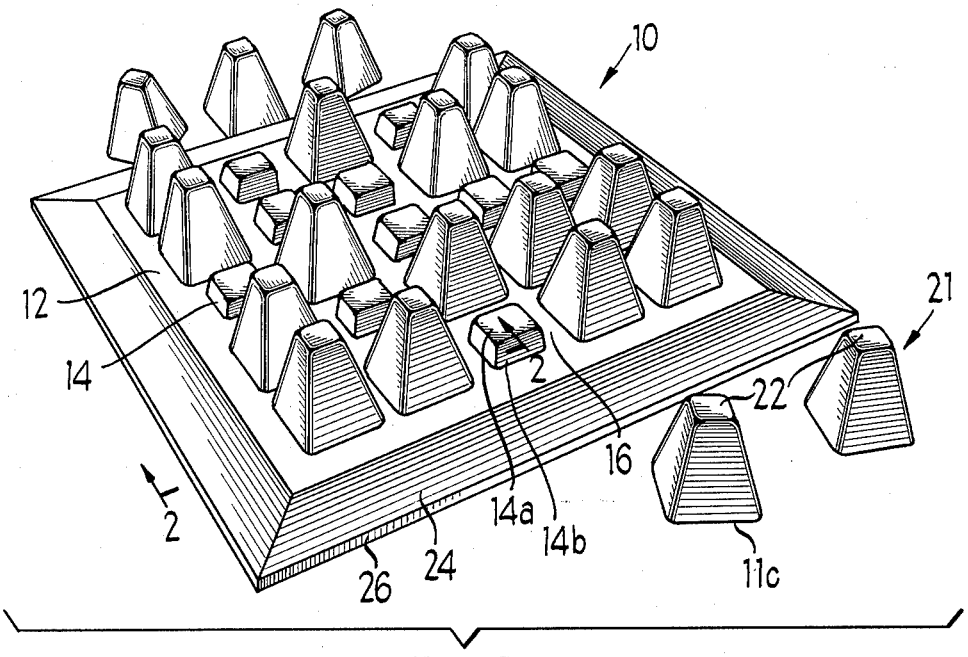
Fig 1
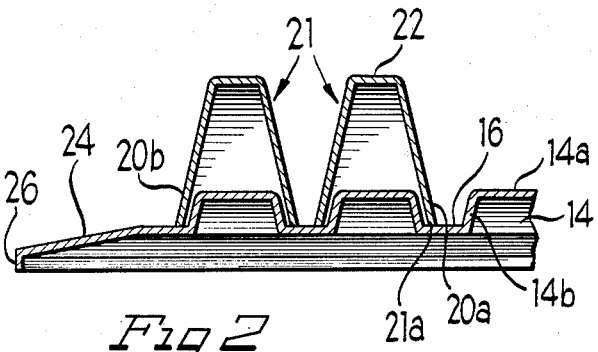
Fig 2
Fig 4
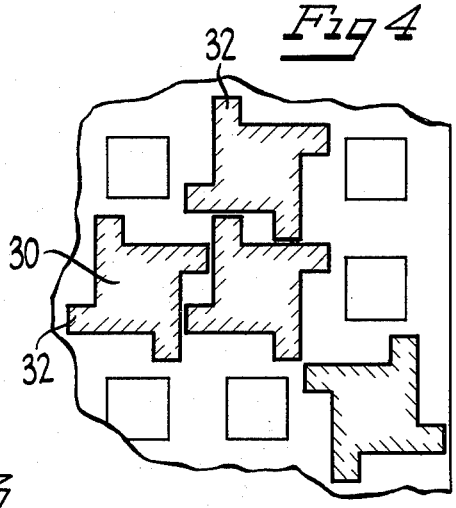
Fig 3
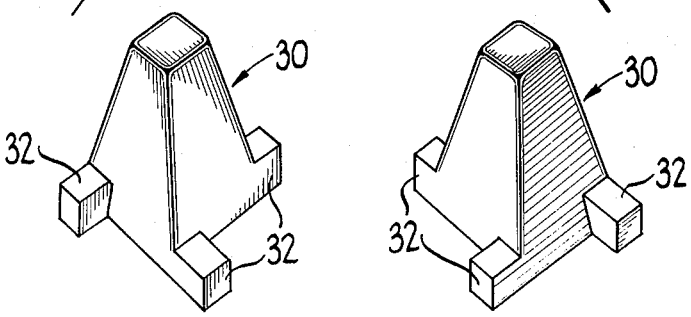

GAME WITH PIECES PREVENTING ADJACENT PLACEMENT

BACKGROUND OF THE INVENTION

1. Field of the Invention

This invention relates to games and in particular to a game apparatus having plural sets of playing pieces which may be used by people of any age and by any number of players at a given time.

2. Brief Description of the Prior Art

Many games developed in the past have used an orthoganal array of playing spaces. Typical of these types of games are checkers or chess. These prior art games have not developed a scheme or method of play whereby the placement of playing pieces is defined with reference to occupied or unoccupied spaces of the opposing set or the orientation of the pieces to each other. Rather, there is usually a steadfast scheme encompassing coloring or numbering and often times chance, whereby a determination of where the piece may be played is made.

SUMMARY OF THE INVENTION

The object of the present invention is to provide a game apparatus which will be durable and which can be used by people of all ages. In accordance with the above and other objects, the present invention contemplates provision of a generally flat playing board portion having a plurality of playing spaces on which playing pieces may be placed. The playing spaces define rows and columns bounded by grooves which generally correspond and run parallel to the rows and columns of the playing spaces themselves. At least two sets of distinguishable playing pieces are provided, one set for each player of the game. The grooves which border the playing spaces are intended for receiving projecting means on the playing pieces so as to maintain and locate the playing pieces in a particular relationship with reference to each other and with relation to the playing spaces on the board.

The present invention also provides a novel method of playing a game. The method permits the placing of playing pieces, from the sets of playing pieces, upon "playable spaces" which are defined as any playing space which is not occupied and which is not blocked by an opposing playing piece from another set. A blocked or non-playable playing space is defined as one which is adjacent to and in the same row or column as a playing space occupied by a playing piece from the opposing set of playing pieces. The placement of a playing piece by one player is followed by placement by an opposing player, of a playing piece from an opposing set of playing pieces upon any playable space. This sequence is repeated until there are no playable spaces left open upon the playing board. Should it become impossible for one player to place playing pieces upon the playing board because there are no playable spaces open to such placement, he relinquishes his turn. The other player or players, then continue to place their playing pieces on the board. The game is won by the player who has placed the largest amount of playing pieces upon the board at the end of the game or in the case of a tie, the last player wins.

BRIEF DESCRIPTION OF THE DRAWINGS

FIG. 1 is a perspective view of a game board and playing pieces made in accordance with the concepts of the present invention;

FIG. 2 is a partially fragmented vertical section of the game board and playing pieces taken generally along the line 2—2 of FIG. 1;

FIG. 3 is a perspective view of playing pieces utilized in an alternative embodiment of the present invention; and FIG. 4 is a generally diagramatic sectional view of a game board and pieces of an alternative embodiment.

DESCRIPTION OF THE PREFERRED EMBODIMENT

A game apparatus made in accordance with the concepts of the present invention is shown in the perspective view of FIG. 1 and generally designated by the reference numeral 10. The game apparatus includes a playing board 12 having a plurality of playing spaces 14, each generally square in shape, raised, and arranged in rows and columns. These playing spaces are separated from each other by grooves 16 following a line generally parallel to the direction of the rows and columns of spaces. The playing spaces 14 are raised portions appearing upon the surface of the board 12. The playing spaces have a generally flattened top **14*a*, four sides 14*b* which are generally vertically disposed but which in some adaptations of the invention, deviate inwardly from the vertical. These grooves border each of the playing spaces on all sides. At the outer perimeter of said playing board, is a tapered portion 24 which is in communication with a vertical outer edge 26 of the board 12** which is essentially vertically disposed.

The game apparatus 10 includes two or more color coded sets of playing pieces, generally designated by the reference numeral 21. The playing pieces 21 are of a generally four-sided, pyramidal shape. The playing pieces 21 each include means **20*a* extending from the bottom 21*a* of the playing piece which are intended for removable interlocking with the grooves 16 bordering the playing spaces 14. The projecting means 20*a* of the playing pieces may take several different forms. One form may be achieved by at least partially hollowing out the generally pyramidal shaped playing pieces so that a depending skirt 20*b* of the sides of the playing pieces slides over the upwardly extending portion of the playing spaces 14. The intersection of all four depending skirts 20*b*, on a playing piece, defines a hollowed cavity 11*c* on the bottom of the playing pieces and the top surface 22** of the playing pieces may be generally flattened as shown. Preferably the playing piece material would be plastic, wood or some other sturdy material. The playing pieces are provided with means so that opposing sets may be distinguished such as differential coloring, shape or similar means.

The present invention includes a method of playing the game with the above-described apparatus. The method of play comprises the placement by one player of one playing piece 21 from his set upon a "playable space" 14 on the board 12. An open or "playable space" is defined to be one which is not occupied and not blocked. A blocked space is defined as one which is adjacent to and in the same row or column as a playing piece from an opposing set. The play of one player is followed by a corresponding placement upon an open space by the opposing player, or player in sequence.

This procedure is continued until there are no playable spaces upon which any pieces may be placed. If a player cannot play because there are no playable spaces, the opposing player or players may continue to place their playing pieces upon the board. The game is won by the player, who at the end of the game has placed the higher number of pieces on the board. In case of a tie between two players, the second player wins.

An alternate embodiment utilizes modified playing pieces 30 of generally similar construction as those of the preferred embodiment, but which include a plurality of protuberances 32 extending outwardly from the base of the playing pieces 30 and which act as a mechanical obstructing means. The protuberances 32 are generally cube-shaped and are affixed to the sides of the playing pieces 30 at the corners. The protuberances 32 are arranged on opposing playing pieces in mirror image fashion. As a result of the protuberances 32, opposing playing pieces 30 bear a structural relationship to each other whereby it is impossible to make an incorrect move according to the above rules of play i.e., it is impossible to place a playing piece 30 in abutting relationship to an opposing playing piece 30 in the same row or column of playing spaces 14. The alternate embodiment requires that only two sets of opposing playing pieces 30 be used.

The foregoing detailed description has been given for clearness of understanding only and no unnecessary limitation should be understood therefrom, as some modification will be obvious to those skilled in the art.

What is claimed as new and desired to be secured by Letters Patent of the United States is:

1. A game apparatus, comprising:

a game board having a field defining an m by n array of playing spaces arranged in rows and columns on the field;

two sets of generally pyramid shaped playing pieces, each set of playing pieces having a plurality of playing pieces with distinguishing means thereon identifying all the playing pieces of one set;

locating means for removably interlocking the playing pieces with the playing spaces, said locating means comprising receiving means on the playing pieces and projection means at each of the playing spaces wherein the receiving means on the playing pieces includes a depending portion adapted to receive the projection means defining said playing spaces; and obstructing means provided on the playing pieces, said obstructing means on the playing pieces of opposing sets being arranged so as to prevent the placement of opposing playing pieces in abutting relation in the same row or column of playing spaces.

2. The apparatus of claim 1 wherein said obstructing means comprise generally cube-like protuberances on the sides of said playing pieces.

3. A game apparatus, comprising:

a hollow game board having a generally planar surface with means defined by an m by n array of playing spaces arranged in rows and columns on the playing surface, said playing surface being supported in a horizontal orientation by a vertical peripheral wall and a tapered connecting wall extending between the edges of the playing surface and the vertical wall;

two sets of playing pieces, each set of playing pieces having a plurality of generally pyramid-shaped playing pieces with distinguishing means thereon identifying all of the playing pieces of one set;

locating means for removably interlocking the playing pieces with the playing spaces, said locating means comprising receiving means on the playing pieces and projecting means at each of the playing spaces; and means on the playing pieces for preventing the placement of playing pieces of opposite sets in adjacent positions in the same row or column.

* * * * *